United States Patent [19]

Bristow et al.

[11] 4,360,322

[45] Nov. 23, 1982

[54] POSITIVE DISPLACEMENT PUMP SYSTEMS

[75] Inventors: Ian T. Bristow, Higham; Nigel J. Petts, Rochester, both of England

[73] Assignee: Hobourn-Eaton Limited, Rochester, England

[21] Appl. No.: 101,788

[22] Filed: Dec. 10, 1979

[30] Foreign Application Priority Data

Dec. 13, 1978 [GB] United Kingdom ..... 48268/78
Dec. 13, 1978 [GB] United Kingdom ..... 48269/78

[51] Int. Cl.[3] ..... F04B 49/00

[52] U.S. Cl. ..... 417/300; 417/302; 417/304

[58] Field of Search ..... 417/300, 302, 303, 304, 417/308, 288

[56] References Cited

U.S. PATENT DOCUMENTS

| | | | |
|---|---|---|---|
| 2,279,176 | 4/1942 | Pardee | 417/302 |
| 2,755,741 | 7/1956 | Erskine | 417/304 |
| 2,797,550 | 7/1957 | Stelzer | 417/302 X |
| 3,366,065 | 1/1968 | Pace et al. | 417/302 |

*Primary Examiner*—Richard E. Gluck
*Attorney, Agent, or Firm*—Wenderoth, Lind & Ponack

[57] ABSTRACT

A positive displacement pump system has two delivery passages communicating under the control of a valve with a main discharge passage and/or an overspill duct. The valve is constituted by a valve member slidably mounted in a valve bore and the valve member has lands and intermediate recesses controlling communication between the delivery passages and the overspill duct. The pressures upstream and downstream of a discharge orifice in the discharge passage are applied to the valve member in opposition to each other, increase of the pressure drop tending to move the valve member to increase the amount of fluid passed to the overspill duct. To overcome the known tendency for a valve member to be subjected by the hydraulic forces to a large closing force when the valve is open to only a small extent, the valve is designed to provide for a relatively large opening force at least when the valve is commencing to open. In one construction this is achieved by passing the flow from the second to the main discharge duct through the valve member in a manner producing a jet reaction on the valve member to assist the normal regulating force on the member. In alternative arrangements the additional force is derived from an additional pressure drop induced in the flow from the delivery passage, the higher pressure being applied to valve member in a sense to increase the amount of fluid passed to overspill.

8 Claims, 3 Drawing Figures

POSITIVE DISPLACEMENT PUMP SYSTEMS

This invention relates to positive displacement pump systems.

According to the present invention there is provided a positive displacement pump system having a first pressure fluid delivery passage connected to a main discharge passage containing a discharge orifice, a second pressure fluid delivery passage connected to the first delivery passage under the control of a valve comprising a valve member slidably mounted in a valve bore, said valve member having applied to it a force derived from the pressure drop across said orifice and operating in response to an increase of said pressure drop above a predetermined value to move the valve member to cause fluid from the first and second delivery passages to be by-passed through an overspill port as the said pressure drop increases, and means for superimposing on the valve member an additional force which is derived from the delivery pressure in one of said delivery passages and which operates in the same sense as the first said force.

Preferably said additional force varies as the square of the fluid delivery pressure from which it is derived.

In one embodiment of the invention, the pressure fluid from the second delivery passage flows through an axial duct extending through a part of the length of the valve member and opening through an axially facing port in the valve member to join the flow through the first delivery passage, the reaction force of the flow emerging from said port constituting said additional force. Preferably the end portion of the axial duct terminating in said port is of convergent cross-section thereby to form a nozzle.

In another embodiment of the invention, said one end portion of the valve has a reduced diameter extension which forms with the valve bore an annular restriction between the first fluid delivery passage and the main discharge passage, the pressure upstream of the orifice being applied to the annular area of the valve member formed at the location of the reduction of diameter, and the pressure of the fluid at the upstream end of the annular restriction is applied to the end face of the reduced diameter extension thereby to provide said additional force.

Figure 1:
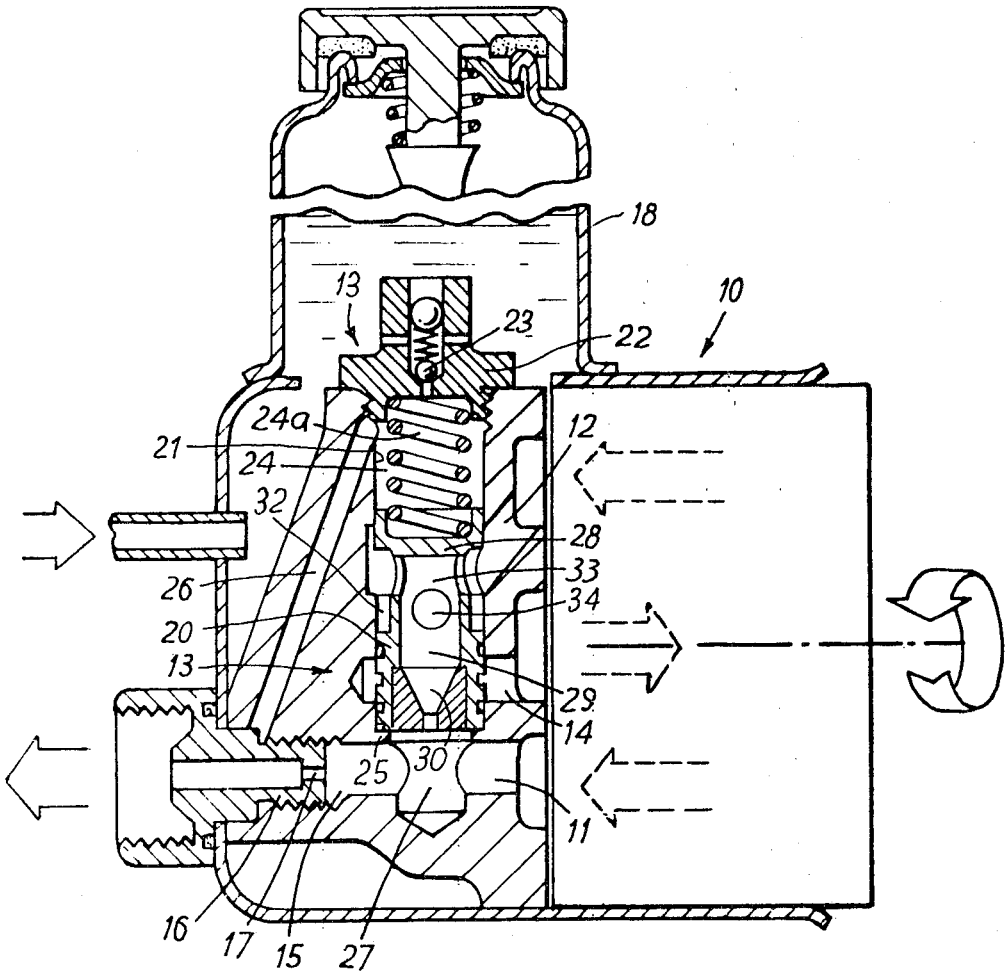
Figure 2:
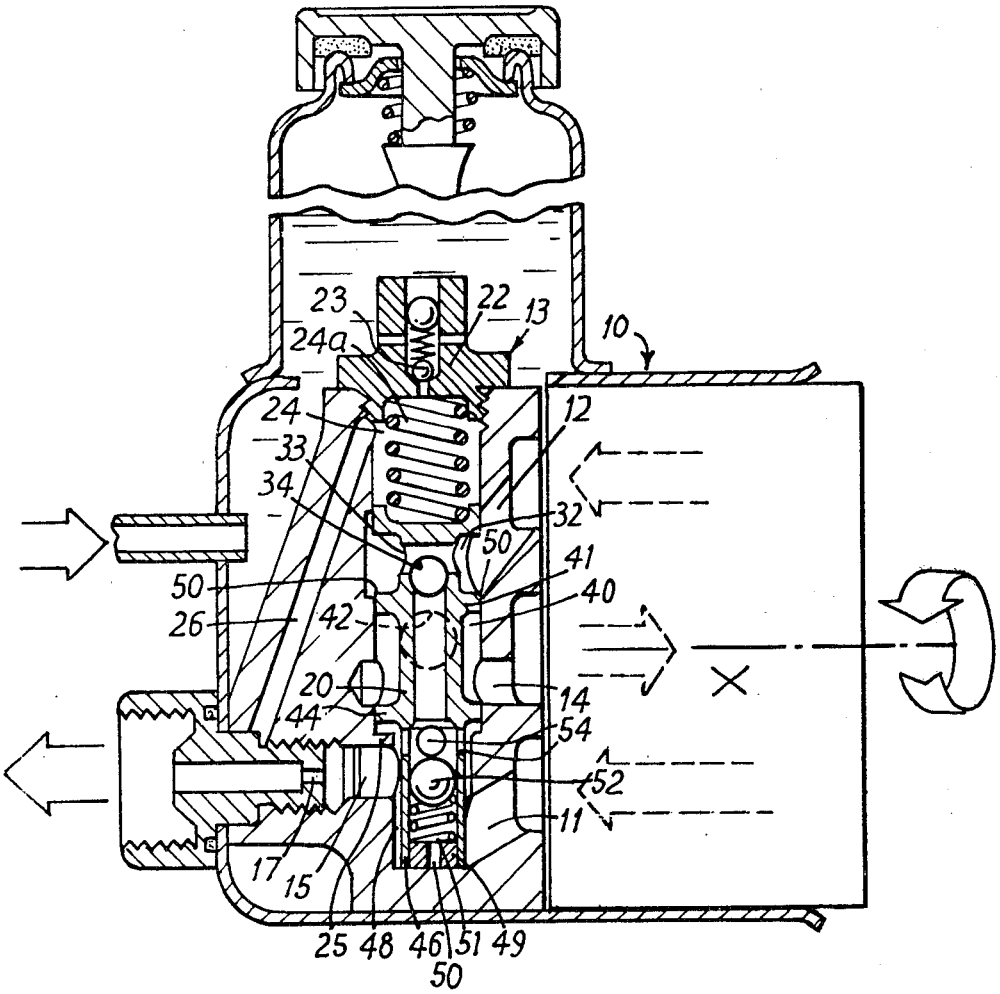
Figure 3:
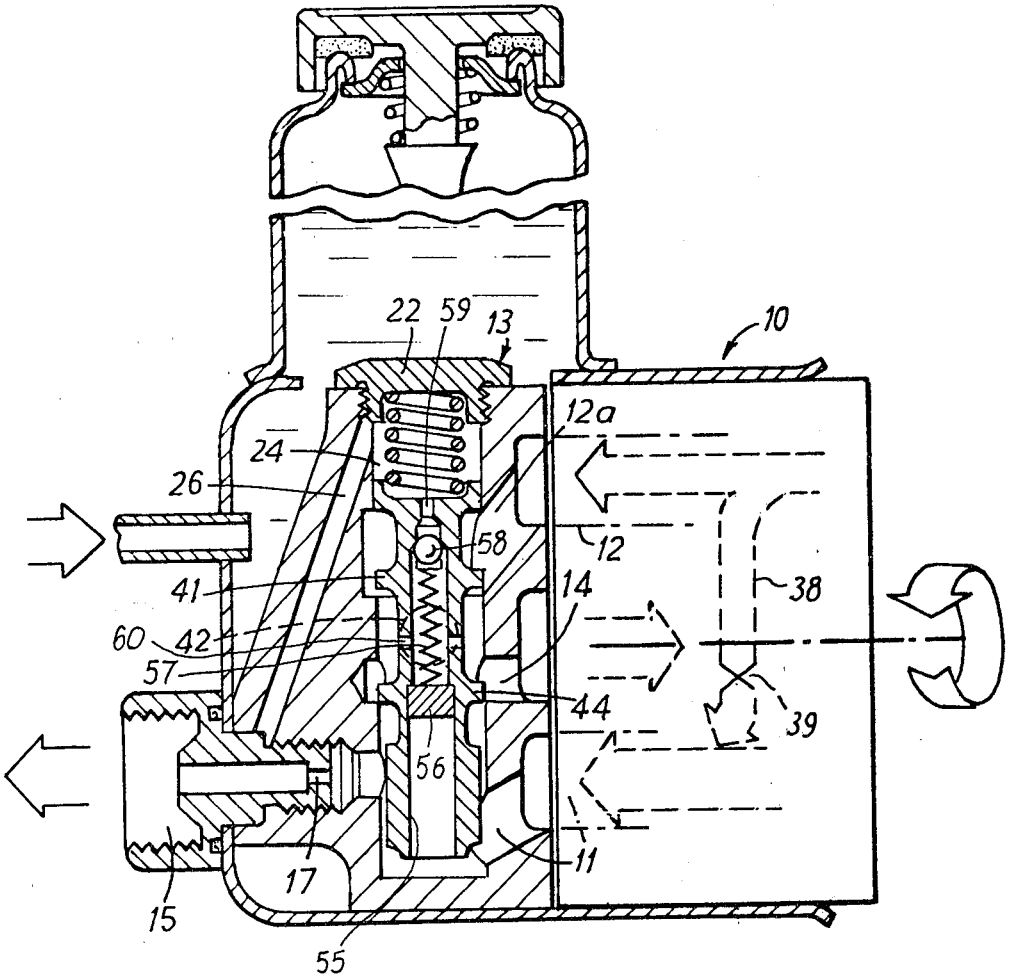

Some embodiments of the invention will now be described by way of example with reference to the accompanying diagrammatic drawings in which:

FIGS. 1, 2 and 3 respectively illustrate in partial cross-section three pump systems according to the invention.

In the drawing similar components are indicated by corresponding reference numerals. The form of positive displacement pumping mechanism indicated generally at 10 is not material to the invention but the pump is required to deliver pressure fluid to first and second delivery passages 11, 12 which are in communication with each other under the control of a control valve 13. The combined flow from passages 11 and 12, less any which is surplus to the immediate requirements of the external circuit and which is directed to an overspill port 14 in the valve and thence to a fluid reservoir or the pump inlet for recirculation, is delivered to the external circuit through a main discharge passage 15 in which is mounted a threaded plug 16 providing a discharge control orifice 17. The orifice is of accurately predetermined diameter according to the required fluid delivery, and the pressure drop across the orifice is applied to the valve 13 to maintain the flow through the orifice substantially constant. Such a pump may supply pressure servo-fluid, for example to the open-centre servo valve of a servo-assisted vehicle steering mechanism.

Referring now to FIG. 1, the valve 13 comprises a valve member 20 slidably mounted in a valve bore 21. The upper end of the valve bore has screwed into it a plug 22 carrying a spring-loaded ball relief valve 23 through which fluid under excess pressure in a chamber 24 formed at the upper end of the bore can be discharged into the encompassing fluid reservoir 18. Chamber 24 contains a spring **24*a* which urges the valve member 20 downward into abutment with an annular shoulder 25 at the other end of the valve bore. Chamber 24 communicates through a drilling 26 with the main discharge passage 15 at a location downstream of the orifice 17**.

The lower end of the valve bore opens through an aperture bounded by the shoulder 25 with a smaller-diameter extension 27 of the valve bore, placing the first delivery passage 11 in permanently open communication with the main discharge passage 15 so that the pressure at the upstream side of the orifice 17 is applied to the lower end of the valve member. The pressures at the upstream and downstream sides of the orifice 17 are thus respectively applied against the lower and upper ends of the valve member.

The upper end portion 28 of the valve member blocks off communication between the secondary delivery passage 12 and the spring chamber 24. From below the portion 28 the valve member has a central axial bore 29 the lower end portion of which has a convergent cross-section forming a nozzle 30 opening to the bore extension 27. Below portion 28 the valve member has a reduced-diameter part forming about it an annular space 32 to which the second delivery passage opens, and two sets of ports 33, 34 in the wall of the reduced-diameter part of the valve member place the central bore 29 in communication with the second delivery passage 12 via space 32.

At low pressure and low pump speed the flow from passage 12 flows through space 32, ports 33, 34, bore 29 and nozzle 30 to join the flow passage 11 through the main discharge passage 15. Under these conditions the valve member is held against the shoulder 25 by the spring **24*a*, and in this position the valve member blanks off the overspill port 14**.

As the pump speed increases, the total delivery of the pump increases but the demands of the external circuit can be met to an increasing degree by the delivery through passage 11. Initially, the increased flow through the discharge orifice produces an increased pressure drop which is applied to the valve member and causes the valve member to move against the force of spring **24*a* until the bottom edge of the valve member commences to uncover the overspill port 14. As this occurs there is a tendency, owing to what is known as the Bernoulli effect, for the valve member to move sharply to cover the overspill port again but in the illustrated construction this effect is offset to a substantial extent by an additional force which comes into play at substantially this stage of operation. The additional force is derived from the reaction, acting in an upward direction on the valve member, of the kinetic energy of the jet issuing downward from the nozzle 30. The additional force is thus a function of the square of the speed of the flow through nozzle 30 and hence of the quantity of fluid delivered to the second delivery passage 12**. Thus the valve member is also moved a greater amount against the spring force than would otherwise be the case for a given increase in pump speed and increases the rate of opening of the overspill port. For power-assisted steering in motor vehicles, the requirement for reduced flow at low pressure at high vehicle speeds exists in some cases, and the delivery characteristic of the pump shown is thus capable of being matched to the steering force requirement.

The control valve shown in FIG. 2 is constructed in a different manner and operates somewhat differently from that in FIG. 1. In this construction the first and second delivery passages 11, 12 are separately connected, under overspill conditions, to overspill porting. For this purpose the valve member has an additional reduced-diameter portion forming a second annular space 40 separated from the annular space 32 by a land 41. An auxiliary overspill port 42 opens to the annular space 40 and communicates through the valve body with the overspill passage leading from the overspill port 14. A land 44 at the lower end of the annular space 40 cuts off communication between the first delivery passage 11 and overspill port 14 when the valve member is in its lowermost position as shown in FIG. 2.

The valve member has a reduced-diameter extension sleeve 46 projecting below the shoulder 25 and the lower end of the extension is shown resting on the bottom of the extended valve bore and holding the land 44 away from the shoulder 25. In this construction the first delivery port 11 and main discharge passage 15 are spaced from each other lengthwise of the valve bore, and an annular gap between the sleeve 46 and the surrounding part of the valve bore forms a flow restriction 48 between passages 11 and 15. A plug 49 having a venting passage 50 is secured in the lower end of the sleeve 46, and light spring 51 rests against the plug and urges a ball 52 against a seating at the lower end of the axial bore of the valve member to form a non-return valve, which permits pressure fluid to flow from the second delivery passage through an axial bore and through radial ports 54 in the sleeve to the main discharge passage 15, but not in the reverse direction.

In operation of this construction under low pump speed and low delivery pressure conditions this flow from the second delivery passage 12 joins the flow from passage 11 which has passed through the annular restriction 48, the combined flow then being discharged through passage 15. As the pump speed increases, any tendency to increase the rate of flow above the design rate produces an increased pressure at the upstream side of the discharge orifice and this pressure acting on the annular area of land 44 overcomes the effect of spring 24*a* and lifts the valve member so that land 44 commences to uncover the overspill port 14 to the combined flows from passages 11 and 12. At the same time, the land 41 moves to place delivery passage 12 in communication with the overspill ports 14 and 42 by way of the annular space 40. As in the previously described construction, the Bernoulli effect acts to apply a strong force to the valve member tending to close the communication with the overspill ports when the area of communication is small. This force is offset in the construction of FIG. 2 by an additional force resulting from the pressure of the fluid at the upstream end of the annular restriction 48 acting on the lower end of the sleeve and plug 49. This pressure is higher than it would be if the sleeve and annular restriction were not present. As the pump speed continues to increase the valve member is moved upward by the tendency for the pressure drop across the discharge orifice 17 to increase, and the additional loading acting on the sleeve 46 and plug 49 to lift the valve member increases according to a square law in relation to increases in pump speed. Also since the port 14 is simply a port in the sidewall of the bore and is of smaller area than the overspill port 42, and since a given upward movement of the valve member will result in a much larger increase in the area of the annular gap between the land 40 and the annular edge 50 leading to the annular space 40 and thence to the overspill port 42, it follows that the proportion of the delivery from passage 12 flowing to the overspill increases more rapidly than that of the delivery from passage 11 as the valve member moves upward, so that eventually the whole of the delivery from passage 12 is passed to the overspill. The whole of the needs of the external circuit are then supplied from passage 11 while a proportion of the delivery from passage 11 is also being passed to overspill through the port 14.

A further advantage of the construction shown in FIG. 2 arises in relation to leakage between the delivery passage 12 and the spring chamber 24 past the upper end portion 28 of the valve member. At high pressure delivery but low pump speed, the pressure difference between passage 12 and the spring chamber is small and thus leakage past the end portion 28 into the spring chamber is small. The pressure in the spring chamber remains up to its proper value and the valve is held in its closed position until the pressure conditions predetermined by the spring loading and the discharge orifice to result in opening the valve are attained. However, when the external system does not need the output from the second delivery passage 12, the pressure in the main discharge passage and hence in the spring chamber will fall. Nevertheless, the pressure in passage 12 will be even lower than in the spring chamber because the valve will be open to a substantial extent, and in consequence there will be a high leakage rate from the spring chamber into passage 12, causing the pressure drop in the spring chamber to increase and the valve opening to increase. An increased amount of fluid from the delivery passages 11 and 12 will therefore be passed to overspill. This helps to improve the regulation of the valve by assisting in keeping the flow to the main discharge passage constant under high pump flow conditions. Also since the leakage from the passage 12 to the spring chamber is turned to advantage, manufacturing tolerances in the leakage zone are less critical.

Referring now to FIG. 3, a modified version of the arrangement of FIG. 2 is shown. In this modified arrangement, the second delivery passage 12 is connected to the first delivery passage 11 through a passage in the valve body instead of through the hollow valve member, and the port 12*a* of passage 12 serves only for overspill fluid. The valve member is shown in a position in which there is partial overspill of the fluid delivered through passage 12. The connecting passage is indicated diagrammatically at 38 and has disposed in it a spring-loaded non-return valve 39 which permits fluid to flow from passage 12 to passage 11 but not in the reverse direction, so that when the valve member reaches a position in which the whole of the flow passage 12 is being passed to the overspill ports 14, 42 via the annular space 40, valve 39 closes to isolate passages 12 and 11 from each other. An axial bore 44 extending along the valve chamber contains a sealing plug 56 which constitutes a base for the spring 57 of a pilot relief valve 58 for relieving, via an axial passage 59 and radial holes 60, excess pressure in the spring chamber 24. Valve 58 thus replaces the relief valve 23 in the arrangement of FIG. 2 but operates in a similar way, by venting the spring chamber to the overspill port 14 to cause the valve member to move upward and permit an increased flow of fluid from passage 12 or passages 12 and 11 through the overspill ports 42 and 14, thus reducing substantially the amount of fluid delivered into the main discharge passage 15.

It will be understood that although the deliveries of fluid to the first and second delivery passages are derived from a single pump in the illustrated arrangements, these deliveries could if desired be obtained from separate pumps.

The arrangements illustrated in FIGS. 2 and 3 have numerous advantages and permit other advantages to be obtained by appropriate design according to the purpose for which the pump is required, as follows:

(1) Since at high pump speeds the whole of the flow delivered to the second delivery passage is by-passed from the external circuit and is directed at low pressure into the overspill, substantial energy is saved at these higher pump speeds; furthermore, since this overspill liquid is not pumped to a high pressure its temperature remains at a lower value, which is advantageous in itself because it leads to a lower mean temperature of the body of working fluid in the pump system, but which leads to the further advantage that leakage from the pump is reduced, enabling a smaller pump to be used, and this in turn leads potentially to a saving in manufacturing costs and to a further saving of energy.

(2) Since the whole of the flow from one of the two delivery passages is, at high pump speeds, by-passed from the external circuit and passed on to an overspill passage, it can be advantageous to use a pump in which unequal quantities of pumped fluid are delivered to the two delivery passages, and in some important applications of the pump the second delivery passage may have the larger quantity of fluid pumped into it, with consequent increased energy saving at higher pump speeds.

(3) The amount of fluid fed to the final flow control section of the valve is much smaller, enabling improved regulation by the valve to be obtained.

(4) It is possible to obtain, plotting pump speed against delivery into the main discharge passage, a flat or falling characteristic, that is to say a characteristic in which the flow into the main discharge passage, having reached a maximum value at a given pump speed is maintained constant or decreases as the pump speed increases.

(5) Where, as in the case of a pump for power-assisted steering, the requirements is for a constant flow in the external circuit, additional pressure is created in the pump delivery for the purpose of moving the valve member to achieve the required control. This additional pressure inevitably introduces losses, but in the present constructions these losses are reduced because a lesser quantity of fluid is pumped to these pressures.

(6) By supplying fluid from the overspill to the pump inlet ports associated with the first delivery passage, improved filling of the pumping chambers in the relevant cycle is improved, and since that reduces the amount of noise emitted from the pump at high speed, the pump can run at higher speeds for a given permissible noise level.

(7) In an arrangement in which the pump is designed to deliver less fluid to the first delivery passage than to the second delivery passage, the former cycle of the pump can operate more satisfactorily at high speed since the amount of fluid to be drawn into the pumping chambers is then less, and since the pump can thus run at a higher speed, a smaller pump can be used.

We claim:

1. A positive displacement pump system having first and second delivery passages for pumped fluid, a main discharge passage which incorporates a discharge orifice and which is in permanently open communication with the first delivery passage, a valve controlling the supply of fluid from the second to the first delivery passage and the quantity of fluid supplied from the first delivery passage to the main discharge passage and comprising a valve bore and a valve member slidably mounted in the valve bore, overspill porting opening to the valve bore, said valve member having applied to it a force derived from the pressure drop across the discharge orifice and operating in response to an increase of said pressure drop above a predetermined value to move the valve member to cause fluid from the first and second delivery passages to be by-passed through the overspill porting, and means for superimposing on the valve member an additional force which is derived from the delivery pressure in one of said delivery passages and which operates in the same sense as the first said force.

2. A pump system as claimed in claim 1, wherein said additional force varies as the square of the fluid delivery pressure from which it is derived.

3. A pump system as claimed in claim 2, wherein the valve member has an axial duct extending along part of its length and terminating in an axially facing port, which duct serves for the flow of fluid from the second delivery passage to the first delivery passage, the reaction force of the flow emerging from said axially-facing port constituting said additional force.

4. A pump system as claimed in claim 3, wherein the end portion of the axial duct terminating in said axially-facing port is of convergent cross-section thereby to form a nozzle.

5. A pump system as claimed in claim 1, wherein the first delivery passage and the main discharge passage open to the valve bore at axially spaced locations therein and the valve member has a reduced diameter extension forming with the valve bore a restriction, the fluid pressure at the upstream end of the restriction being applied to the end face of the reduced diameter extension thereby to provide said additional force.

6. A pump system as claimed in claim 5, wherein an annular shoulder is formed on the valve member where the reduced diameter extension commences, the fluid pressures at the upstream and downstream sides of the discharge orifice being respectively applied against said annular shoulder and the end of the valve member remote from said extension.

7. A positive displacement pump system incorporating a valve comprising a valve bore and a valve member slidably mounted in the valve bore, first and second delivery passages respectively opening to an extension of the valve bore and to the valve bore, a main discharge passage opening to the extension of the valve bore at a location axially spaced from the first delivery passage in a direction towards the main part of the valve bore, a restrictor disposed in the main discharge passage, the valve member having a reduced diameter end portion disposed in but having a radial clearance with respect to the extension of the valve bore to form therewith an annular restriction and providing an axially facing shoulder at the location of the reduction in diameter, a chamber being formed at the end of the valve bore remote from the extension, a spring disposed in said chamber and pressing axially against the valve member, overspill porting opening to the valve bore between the second delivery passage and the main discharge passage, first, second and third lands on the valve member disposed respectively axially between the chamber and the second delivery passage, between the second delivery passage and the overspill porting, and between the overspill porting and the main discharge passage, an enlargement of the valve bore being formed where the second discharge passage opens to the valve bore, an axial bore formed in the valve member and opening permanently at one end to said enlargement of the valve bore and at the other end to the downstream end of said annular restriction, a spring-loaded ball valve mounted in the valve member and adapted to close off the axial bore in the valve member if the fluid pressure in the second delivery passage falls substantially to the same value as at the upstream end of the annular restriction, the second and third lands operating respectively to place the enlargement of the valve bore and the downstream end of the annular restriction in communication with the overspill porting when the resultant of the forces on the valve member exceeds a predetermined value.

8. A positive displacement pump as claimed in claim 1 further comprising a connecting passage between said first and second delivery passages upstream of said valve and having a nonreturn valve therein permitting fluid to flow from the second to the first delivery passage but not in the reverse direction, and said valve bore having an extension into which said first delivery passage opens and said main discharge passage opens opening out of said extension at a location axially spaced from the first delivery passage in a direction toward the remainder of said valve bore, said discharge orifice being a restrictor in said main discharge passage, said additional space force superimposing means being a reduced diameter end portion on said valve member and disposed in and having a radial clearance with respect to said extension of said valve bore for forming therewith an annular restriction, the end of the valve bore remote from said extension having a chamber therein, said system further having a spring disposed in said chamber and pressing axially against the valve member, said overspill porting opening to the valve bore between the second delivery passage and the main discharge passage, said valve member having first, second and third lands thereon disposed respectively axially between the chamber and the second delivery passage, between the second delivery passage and the overspill porting, and between the overspill porting and the main discharge passage, the valve bore having an enlargement therein where the second discharge passage opens to the valve bore, said valve member having an annular spaced therearound between the second and third lands, said valve member having an axial bore therein opening permanently at one end to said annular space and opening at its other end to said chamber, a relief valve mounted in said axial bore for relieving excess pressure in the chamber, the second and third lands operating respectively to place the enlargement of the valve bore and the downstream end of the annular restriction in communication with the overspill porting when the resultant of the forces on the valve member and the relief valve exceeds a respective predetermined value.

* * * * *